United States Patent [19]

Giannotti

[11] Patent Number: 4,524,748

[45] Date of Patent: Jun. 25, 1985

[54] APPARATUS FOR SEPARATING AND RE-CIRCULATING OVERSIZE FUEL PARTICLES IN SPARK-IGNITION ENGINES

[76] Inventor: Hugo V. Giannotti, 879 S. Country Rd., E. Patchogue, N.Y. 11772

[21] Appl. No.: 387,352

[22] Filed: Jun. 11, 1982

[51] Int. Cl.[3] ..... F02M 31/00

[52] U.S. Cl. ..... 123/591; 123/548; 123/559; 48/189

[58] Field of Search ..... 123/590–593, 123/548, 559; 48/180.1, 189.4; 261/78 R

[56] References Cited

U.S. PATENT DOCUMENTS

| | | | |
|---|---|---|---|
| 1,730,641 | 10/1929 | Brush | 123/548 |
| 1,854,298 | 4/1932 | Godward | 123/548 |
| 3,832,985 | 9/1974 | Edde | 123/548 |
| 3,847,125 | 11/1974 | Malherbe | 123/548 |
| 3,935,847 | 2/1976 | Gamell | 123/559 |
| 3,966,430 | 6/1976 | Stephens | 48/189.4 |
| 3,998,195 | 12/1976 | Scott | 48/189.4 |
| 4,016,845 | 4/1977 | Marsee | 123/548 |
| 4,019,482 | 4/1977 | Pugliese | 123/591 |
| 4,020,811 | 5/1977 | LaForce | 123/548 |
| 4,024,849 | 5/1977 | Hoots | 123/593 |
| 4,106,457 | 8/1978 | Totten et al. | 123/548 |

*Primary Examiner*—E. Rollins Cross

[57] ABSTRACT

There is disclosed a device for separating oversize fuel particles in an air fuel mixture in internal combustion engines and recirculating them to the fuel supply system for reinjection and atomization by the carburetor or fuel injector. An array of low loss venturi nozzles with central traps is utilized to inertially separate the oversize particles, resulting in a fine, more uniform fuel size distribution to the engine inlet.

8 Claims, 9 Drawing Figures

APPARATUS FOR SEPARATING AND RE-CIRCULATING OVERSIZE FUEL PARTICLES IN SPARK-IGNITION ENGINES

The desirability of uniform, small fuel droplets for internal combustion engines is well-documented. Combustion efficiency is improved as is distribution, permitting operation at leaner mixtures and increased compression ratio, with consequent decrease in fuel consumption. Approaches to reduce fuel particle size have included vaporization techniques, multiple venturi carburetors, sonic venturis, and ultrasonic devices. All of these approaches have one or more of the following disadvantages: lowered volumetric efficiency, low cost effectiveness, high pressure drop, large size, high power consumption, wear, complexity, and high start-up emissions. Further, these methods have in common the additional atomization or vaporization of fuel particles—the functions normally relegated to the carburetor or fuel injector. In this invention, the oversize fuel particles, instead of being further atomized, are separated from the air-fuel mixture and returned to the fuel supply system for re-injection and atomization by the carburetor or fuel injector.

The fuel size distribution from a carburetor or injection nozzle covers a wide range and could range to about 200 micron. A finer distribution is desirable and a range extending to about 20 micron is both preferable and achievable, although any substantial reduction in fuel particle size is desirable. Removing the particles above a pre-determined size would result in improved air/fuel distribution, improved combustion, and reduced emissions. This invention describes, in an engine system, method and means by which the oversize fuel particles are separated using a particle separator, and returned to the fuel supply system or carburetor.

In a normally aspirated engine, the scavenge flow which carries the oversize fuel particles is at a pressure lower than atmospheric and consequently the scavenge flow must be pumped back to the fuel supply system or led to a lower pressure section such as the carburetor throat. In a turbocharged engine, wherein the manifold which contains the particle separator is pressurized, the scavenge flow can be returned, without pumping, to the fuel supply system, through a suitable metering valve.

One type of particle separator that can be utilized in the separation of fuel particles has been described in U.S. Pat. No. 3,725,271 patented Apr. 3, 1973. Tests conducted by the Department of the Navy, and documented in Report NAVSECPHILADIV PROJECT T-454, Gas Turbine Combusion Air Salt Aerosol Separator Program, Subproject S-4617X, Task 10500S, show this type of separator to have the highest effectiveness at the lowest pressure drop among all the inertial separators tested in the particle range of 4 to 13 micron, an important range for engine fuel particles. The performance of this separator on salt water spray, as tested by the Department of the Navy, is as follows:

| Air Velocity - Feet Per Second | Efficiency - % Removed by Weight | Pressure Drop Inches of $H_2O$ |
|---|---|---|
| 17.5 | 73 | — |
| 35 | 90 | 1.5 |

It is an object of the invention to provide a device which can separate oversize fuel particles from the flow of an air-fuel mixture and return them to the fuel supply system.

It is another object of the invention to provide a device which can separate oversize fuel particles from the flow of an air-fuel mixture and return them to the carburetor.

It is another object of the invention to provide a device which will separate a substance of a greater density from another substance and more particularly solid or liquid particles from a flow of gas.

In one embodiment of the invention, the device for separating the oversize fuel particles consists of an array of venturi nozzles fitted with a central trap downstream of the throat into which the oversize particles are inertially urged, together with a small amount of scavenge air. In addition, means are provided to re-circulate the oversize to a reduced pressure zone such as the carburetor throat for re-atomization, with means for metering the re-circulated flow.

In another embodiment of the invention, the device for separating the oversize fuel particles consists of an array of vortex tubes through which the air-fuel mixture flows, the oversize fuel particles being centrifuged outwards and re-circulated to the carburetor with a small amount of scavenge air.

In another embodiment of the invention, the device for separating the oversize fuel particles consists of an array of venturi nozzles fitted with a central trap downstream of the throat into which the oversize particles are inertially urged, together with a small amount of scavenge air; in addition, means are provided to return the oversize to the fuel supply system via a fuel storage chamber, which is maintained at a reduced pressure, and a fuel pump activated by a level sensor, or, alternatively to return the oversize to the fuel supply system via a pump only.

In another embodiment of the invention, the device for separating the oversize fuel particles consists of an array of vortex tubes through which the air-fuel mixture flows, the oversize fuel particles being centrifuged outwards; in addition, means are provided to return the oversize to the fuel supply system via a fuel storage chamber, which is maintained at a reduced pressure, and a fuel pump activated by a level sensor, or, alternatively, to return the oversize to the fuel supply system via a pump only.

In another embodiment of the invention, the device for separating the oversize fuel particles consists of an improved vortex separator. Reference is made to prior art on vortex separators as described in U.S. Pat. No. 4,158,449 patented June 19, 1979. The improved vortex separator contains an array of vanes or louvered slots disposed forward of the leading edge of the main air discharge tube.

In another embodiment of the invention, the device for separating the oversize fuel particles consists of concentric tubular or rectangular members which cause the main air flow to undulate and separate from the particles which are scavenged out together with a small amount of scavenge air.

Other objects and advantages will become apparent from the following description taken in connection with the accompanying drawings in which.

Figure 1:
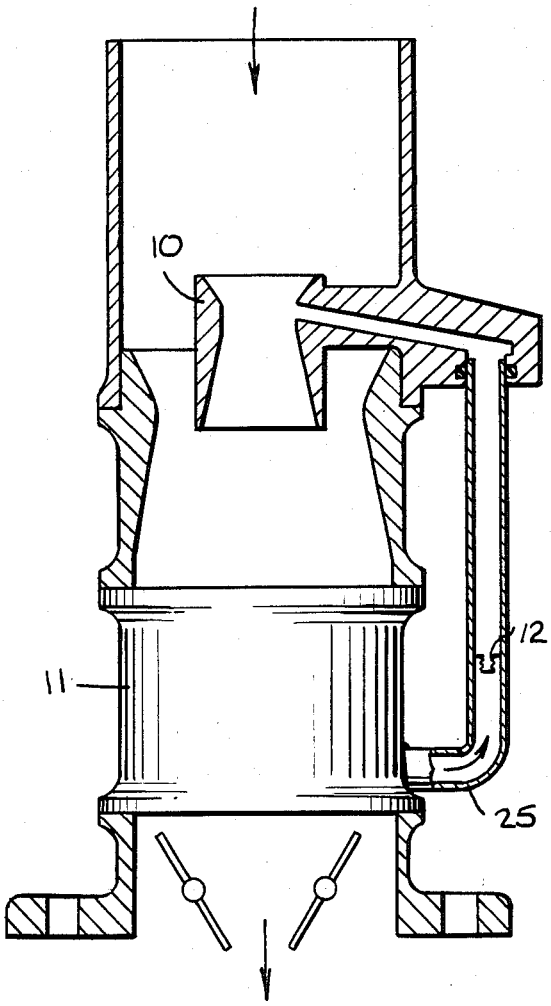
FIG. 1 is a diagrammatic view of the novel combined particle separator and engine throttle body incorporated in the engine inlet and carburetor system.
Figure 4:
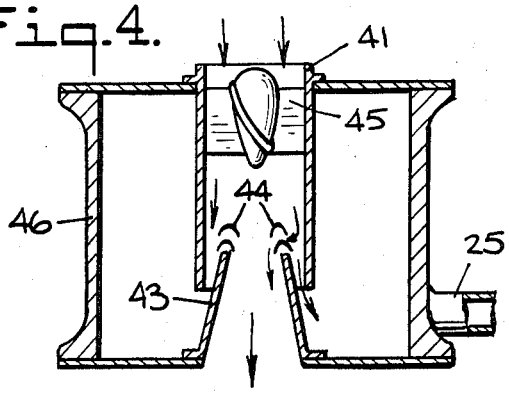
Figure 9:
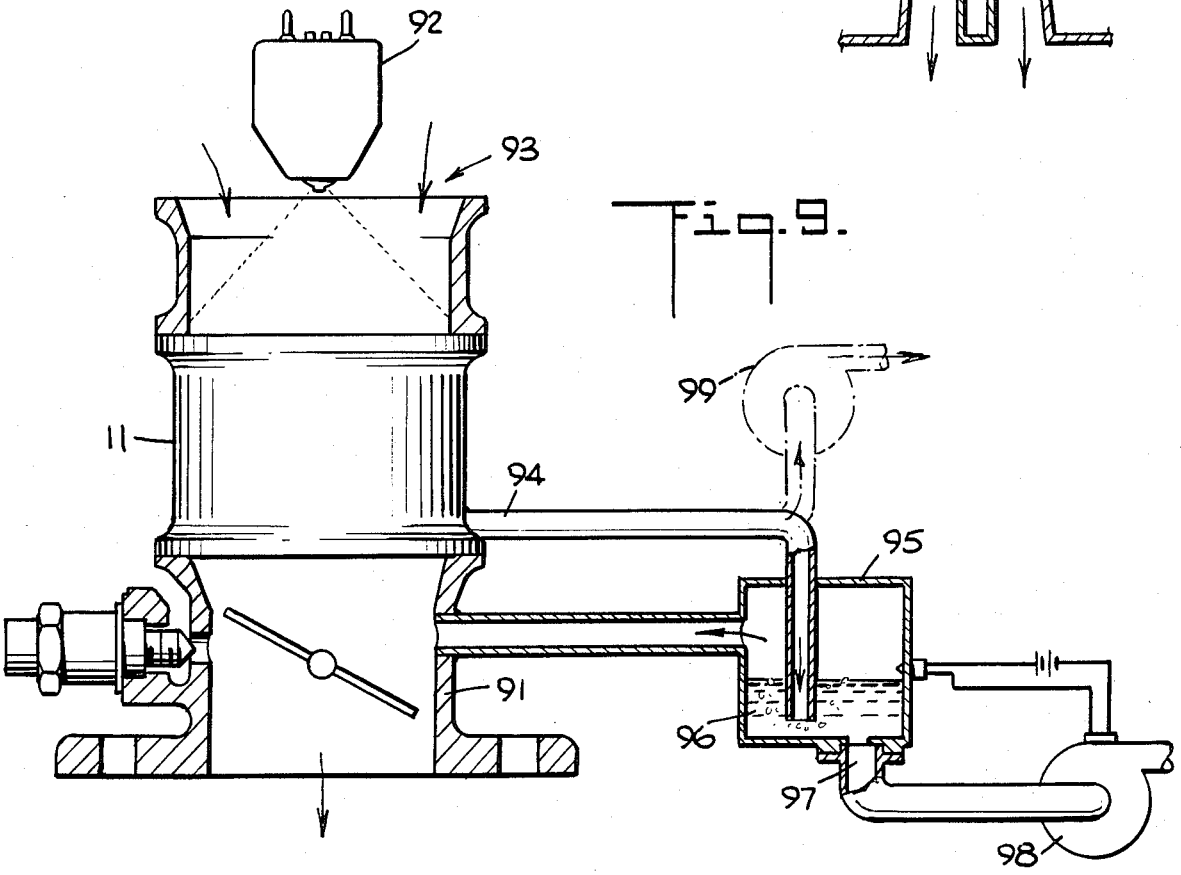

FIG. 4 is a vertical section through another embodiment of the invention showing one of the array of vortex tubes, including an improvement to the vortex tube consisting of a plurality of vanes or louvered slots disposed forward of the leading edge of the main air discharge tube, and a scavenge tube leading away and to the carburetor throat as shown in FIG. 1 or fuel supply system as shown in FIG. 9.

Figure 5:
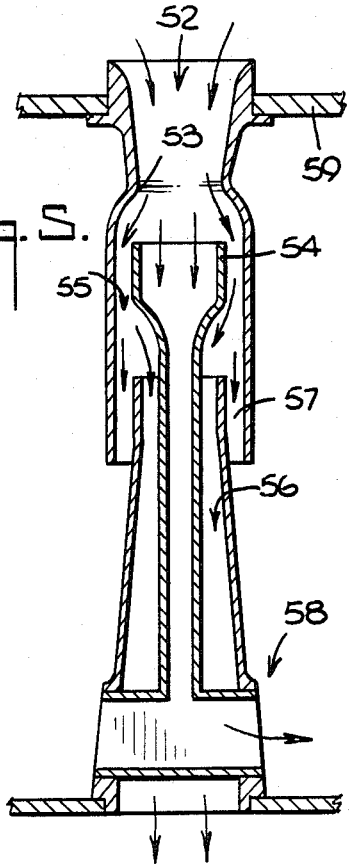

FIG. 5 is a vertical section through another embodiment of the invention showing one of the array of concentric tubes consisting of a particle trap leading to the scavenge outlet and a second particle trap leading to the same scavenge outlet.

Figure 6:
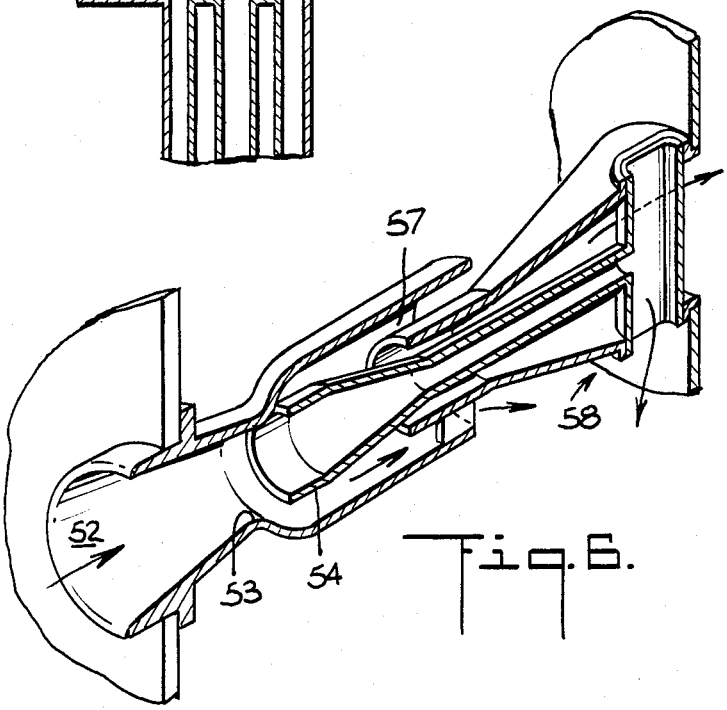

FIG. 6 is a perspective view of the element of FIG. 5.

Figure 7:
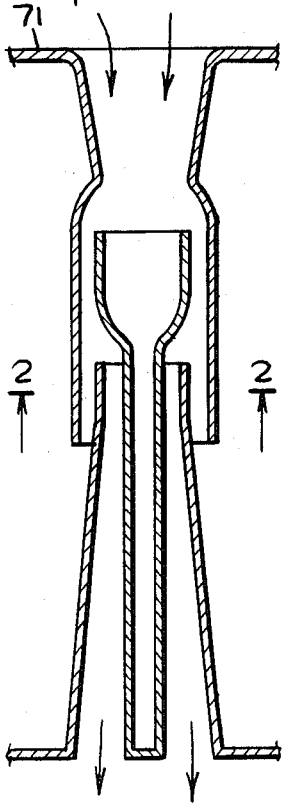

FIG. 7 is a vertical section through another embodiment of the invention showing the separator element contour of FIG. 5 in which the portions forming the trap and diffuser are substantially rectangular, rather than tubular.

Figure 8:
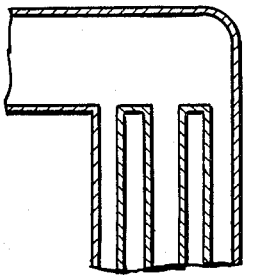

FIG. 8 is an elevational view taken on line 2—2 of FIG. 7 showing the outlet of the substantially rectangular arrangement of FIG. 7.

FIG. 9 is a diagrammatic view of the novel combined particle separator and engine throttle body incorporated in the engine inlet and downstream of a fuel injector nozzle showing the oversize fuel particles being returned to the fuel supply system via a fuel collecting chamber, maintained at reduced pressure, and a pump, or, alternatively, the oversize fuel particles being returned to the fuel supply system via a pump only.

Figure 2:
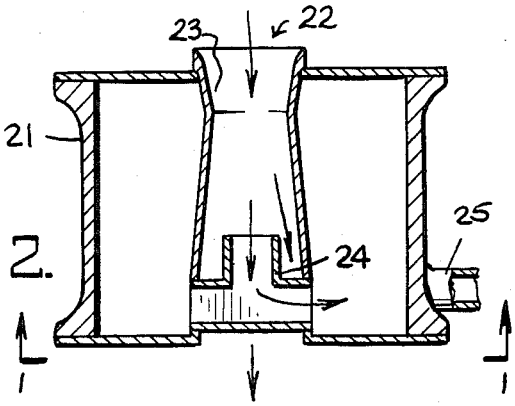
FIG. 2 is a vertical section through one embodiment of the invention, showing one only, for clarity, of the array of venturi nozzles with a central trap downstream of the throat and a scavenge tube leading away and to the carburetor throat as shown in FIG. 1 or fuel supply system as shown in FIG. 9.

Referring to FIGS. 1 and 2, the air-fuel mixture from the carburetor throat 10 enters the separating device 11, which is made up of units such as either 21 of FIG. 2, 46 of FIG. 4, 59 of FIG. 5, or 71 of FIG. 7, sections of which are shown in FIG. 2, FIG. 4, FIG. 5 and FIG. 7. Referring to FIG. 2, particles are quickly accelerated at the inlet section 22 to almost air velocity. Particle inertia of the larger particles causes them to leave the streamline at the throat 23 and then enter the trap 24. The oversize particles or particles greater than a predetermined size are then re-circulated with a small amount of scavenge air through tube 25 to the carburetor throat 10 for re-atomization. Test data for this type of separator have shown that most of the dynamic head is recovered downstream so that the scavenge pressure is higher than the static pressure in the carburetor throat and consequently re-circulation can occur. Since the separating effectiveness increases with increased velocity through the separator a metering valve 12 is shown in the scavenge tube 25 which maintains essentially a constant scavenge flow so that the ratio of scavenge flow to primary air flow is reduced with increase in primary air flow. A reduction in this ratio reduces the separation effectiveness and compensates consequently for the increase in effectiveness as a result of increased velocity through the separator, thereby maintaining essentially a constant size of particles which is separated. The carburetor main metering jet is modified to accept the re-circulated flow.

Figure 3:
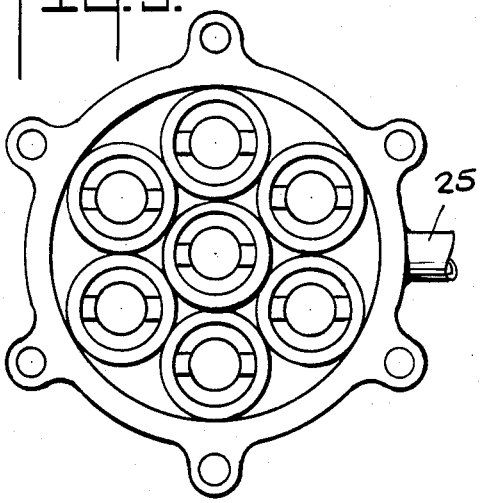
FIG. 3 is an elevational view of FIG. 2, taken along the line 1—1.

Referring to FIGS. 2 and 3 an array of seven separator elements is shown to keep the height of the assembly as small as possible in keeping with maximum open area and minimum pressure loss.

The separating element shown in FIG. 4 is a vortex tube 41. In this case an improvement is shown to a typical vortex tube to increase the separating effectiveness and reduce the pressure loss of the primary flow and secondary flow which is critical in the automotive application. The flow of air and particles is given a rotational flow by the deflectors 45. A vortex is generated causing the heavier particles to be centrifuged towards the outside diameter. Disposed upstream of the main air discharge tube 43 is shown a plurality of louvers or vanes 44. Since the discharge tube is about 50% of the area of the primary tube and since only about 10% scavenge flow is desired, a substantial amount of primary air must make an abrupt change in direction to enter the discharge tube. This increases the separation effectiveness but also increases the pressure loss. By placing turning vanes 44 in the area as shown, the mixing loss of the primary flow is reduced and consequently the overall pressure loss is reduced allowing operation at higher velocities and thereby higher separation effectiveness, or, conversely, lower velocities and reduced scavenge pressure loss for the same effectiveness. Also particle capture is enhanced by virtue of the particles having to traverse a shorter distance from vane to vane and, in so doing, are re-entrained in the next flow streamline and re-accelerated so as to be able to negotiate the following vane gap and enter the capture zone.

Another separating element is shown in FIG. 5, a perspective of which is shown in FIG. 6. The air-fuel mixture enters this separator. Particles are quickly accelerated at the inlet section 52 to almost air velocity. Particle inertia of the larger particles causes them to leave the streamline at the throat 53 and enter the trap 54. The main or primary air flow travels through passages 55 and 56. Additional oversize particles are separated in the air streamline undulation between 55 and 56, these particles entering trap 57 which leads to a common manifold 58 with trap 54 and from there the particles are scavenged out through tube 25. The test data on this concentric geometry have shown that practically 100% of all particles above a size as low as about 2 micron can be efficiently removed.

Another version of the element geometry of FIG. 5 is shown in FIG. 7 wherein the passages are rectangular in cross-section, as shown by FIG. 8, rather than tubular.

Referring to FIG. 9 the separator 11, which could be of configuration as shown in FIGS. 2, 4, 5 or 7, is shown mounted to the throttle body 91, of a single-point injection system engine inlet and downstream of a fuel injector 92. Air enters at 93 and mixes with the fuel, the air-fuel mixture entering the separator 11. The scavenge flow carrying the oversize particles travels through tube 94 to a fuel collecting chamber 95 which is vented to a lower pressure zone, causing scavenge flow. The fuel in the air-fuel mixture in tube 94 is scrubbed out by the fuel 96 in the chamber 95. The level of the fuel 96 is maintained above the outlet of tube 94 by valve 97 and a level sensor which activates a fuel scavenge pump 98 which returns the fuel to the fuel supply system. Alternatively, the oversize can be scavenged out directly to the fuel supply system via pump 99.

In a turbocharged engine, wherein the manifold containing the particle separator is pressurized to a higher pressure than the fuel supply system, then the scavenge flow containing the oversize fuel particles can be returned, without pumping, to the fuel supply system, through a suitable metering valve.

What is claimed is:

1. Apparatus for reducing the average fuel particle size in an air-fuel mixture for spark-ignition engines comprising inertial means for separating a portion of the air-fuel mixture containing fuel particles greater than a pre-determined size prior to its introduction to the cylinders of the engine, and means for returning the separated portion to the fuel supply system of the engine, said separated portion being re-circulated to the venturi portion of the engine from an area of higher staic pressure, wherin said inertial means comprises a particle separator having an array of elements, each element having a venturi-shaped housing and a centrally aligned trap disposed downstream of the throat into which the flow of fuel particles greater than a pre-determined size is inertially separated.

2. Apparatus of claim 1 in which the inertial means comprises a particle separator disposed downstream of a carburetor with a conduit leading from the particle separator to the carburetor, the flow of fuel particles greater than a pre-determined size being re-circulated to the carburetor through said conduit.

3. Apparatus of claim 1 in which the inertial means comprises a particle separator disposed downstream of a pressurized carburetor, as in the case of a turbocharged engine, with a conduit leading from the particle separator to the fuel supply system, the flow of fuel particles greater than a pre-determined size being returned to the fuel supply system of the engine through said conduit.

4. Apparatus of claim 2 in which the conduit contains a flow control valve which reduces the flow through it in response to an increase in pressure drop across it.

5. Apparatus of claim 1 in which the inertial means comprises a particle separator disposed downstream of a fuel injector nozzle with a conduit leading from the particle separator to a fuel collecting chamber, said chamber being evacuated to a low pressure zone, the flow of fuel particles greater than a pre-determined size being fed to said chamber through said conduit and returned from said chamber to the fuel supply system of the engine by suitable means.

6. Apparatus of claim 1 in which the inertial means comprises a particle separator disposed downstream of a fuel injector nozzle with a conduit leading from the particle separator to a pump and then to the fuel supply system of the engine, the flow of fuel particles greater than a pre-determined size being returned to the fuel supply system of the engine through said conduit.

7. Apparatus of claim 1 in which the inertial means comprises a particle separator disposed downstream of a fuel injector nozzle which discharges into a pressurized air chamber, as in the case of a turbocharged engine, with a conduit leading from the particle separator to the fuel supply system of the engine, the flow of fuel particles greater than a predetermined size being returned to the fuel supply system of the engine through said conduit.

8. Apparatus of claim 1 in which the inertial means comprises a particle separator consisting of an array of vortex tubes.

* * * * *